US010442643B2

(12) United States Patent
Edo

(10) Patent No.: US 10,442,643 B2
(45) Date of Patent: Oct. 15, 2019

(54) SHEET FEEDING DEVICE AND IMAGE FORMING APPARATUS INCORPORATING THE SHEET FEEDING DEVICE

(71) Applicant: Yousuke Edo, Kanagawa (JP)

(72) Inventor: Yousuke Edo, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/798,933

(22) Filed: Oct. 31, 2017

(65) Prior Publication Data

US 2018/0141769 A1 May 24, 2018

(30) Foreign Application Priority Data

Nov. 18, 2016 (JP) ..... 2016-225345

(51) Int. Cl.
*B65H 3/48* (2006.01)
*B65H 3/12* (2006.01)
(Continued)

(52) U.S. Cl.
CPC ..... *B65H 3/48* (2013.01); *B65H 1/14* (2013.01); *B65H 3/128* (2013.01);
(Continued)

(58) Field of Classification Search
CPC ..... B65H 3/48; B65H 3/128; B65H 3/124; B65H 3/12; B65H 3/0866; B65H 3/0833;
(Continued)

(56) References Cited

U.S. PATENT DOCUMENTS 6,186,492 B1 * 2/2001 Dechau ..... B65H 1/18 271/11
7,267,337 B2 * 9/2007 Moore ..... B65H 1/18 271/148
(Continued)

FOREIGN PATENT DOCUMENTS

JP 8-333032 12/1996
JP 10-035901 2/1998
(Continued)

OTHER PUBLICATIONS

Machine translation of JP 60-56739, Apr. 1985.*
U.S. Appl. No. 15/483,277, filed Apr. 10, 2017,Hideaki Takahashi, et al.

*Primary Examiner* — Thomas A Morrison
(74) *Attorney, Agent, or Firm* — Harness, Dickey & Pierce, P.L.C.

(57) ABSTRACT

A sheet feeding device, which is included in an image forming apparatus, includes a reference face, a sheet loader, an air blowing device, an air drawing device, and a conveying body. The reference face stands upwardly at a downstream side of a sheet conveying direction. The sheet loader includes a body and a leading end disposed downstream from the body in the sheet conveying direction. The sheet loader moves upwardly to a position where the leading end rotates downwardly to the body. The air blowing device blows air toward a sheet bundle loaded on the sheet loader and lift an uppermost sheet of the sheet bundle. The air drawing device is configured to draw the uppermost sheet. The conveying body conveys the uppermost sheet in the sheet conveying direction while the uppermost sheet is in contact with the air drawing device due to attraction by air.

14 Claims, 5 Drawing Sheets

(51) Int. Cl.

| | |
|---|---|
| ***G03G 15/00*** | (2006.01) |
| ***B65H 1/14*** | (2006.01) |
| *B65H 7/14* | (2006.01) |

(52) U.S. Cl.

CPC ..... *G03G 15/6511* (2013.01); *G03G 15/6514* (2013.01); *B65H 7/14* (2013.01); *B65H 2403/50* (2013.01); *B65H 2405/1136* (2013.01); *B65H 2405/11162* (2013.01); *B65H 2405/11172* (2013.01); *B65H 2406/3662* (2013.01); *B65H 2511/20* (2013.01)

(58) Field of Classification Search

CPC .. B65H 3/0816; B65H 3/08; B65H 2406/323; B65H 2406/2406; B65H 2406/32; B65H 2406/3511; B65H 2406/352; B65H 5/222; B65H 5/224

See application file for complete search history.

(56) References Cited

U.S. PATENT DOCUMENTS

| | | | | |
|---|---|---|---|---|
| 7,316,391 | B2 * | 1/2008 | Stemmle | B65H 3/60 271/148 |
| 2002/0005610 | A1 * | 1/2002 | Moore | B65H 5/34 271/11 |
| 2014/0131938 | A1 | 5/2014 | Satoh et al. | |
| 2017/0174453 | A1 | 6/2017 | Akai et al. | |
| 2017/0174454 | A1 | 6/2017 | Matsuoka et al. | |
| 2017/0174458 | A1 | 6/2017 | Takano et al. | |
| 2017/0174462 | A1 | 6/2017 | Edo et al. | |

FOREIGN PATENT DOCUMENTS

| | | | | |
|---|---|---|---|---|
| JP | 2015-110464 | | 6/2015 | |
| JP | 6056739 | B2 * | 1/2017 | B60R 13/04 |
| JP | 2017-109831 | | 6/2017 | |
| JP | 2017-109863 | | 6/2017 | |
| JP | 2017-145083 | | 8/2017 | |
| JP | 2017-146680 | | 8/2017 | |

* cited by examiner

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application No. 2016-225345, filed on Nov. 18, 2016, in the Japan Patent Office, the entire disclosure of which is hereby incorporated by reference herein.

BACKGROUND

Technical Field

This disclosure relates to a sheet feeding device that feeds a sheet such as a paper, and an image forming apparatus including the sheet feeding device. The image forming apparatus corresponds to, for example, a copier, printer, facsimile machine, and a multi-functional apparatus including at least two functions of the copier, printer, and facsimile machine.

Related Art

Various image forming apparatuses such as copiers, printers, and printing machines include a sheet feeding device that feeds sheets such as papers. Such a sheet feeding device is known to employ an air adsorption method using an air blowing device. For example, by performing the air adsorption method in the above-described sheet feeding device, air is blown from the air blowing device toward an uppermost sheet of a sheet bundle loaded on a sheet loading portion (such as a bottom plate). The uppermost sheet blown by the air blowing device is lifted and attracted to an air drawing device. While the uppermost sheet is being attracted by the air drawing device, a sheet transfer belt conveys the uppermost sheet in a sheet conveying direction.

To be specific, a known sheet feeding device includes a sheet loading portion (a bottom plate), a reference face (a downstream side end), an air blowing device, an air drawing device, a sheet transfer belt (a sheet attraction belt), and so forth.

Among sheets of the sheet bundle loaded on the sheet loading portion, the uppermost sheet is lifted over the sheet bundle and is adsorbed by the air drawing device while the air blowing device is blowing air to an end of the uppermost sheet. By so doing, the uppermost sheet is attracted to the sheet transfer belt. As the sheet transfer belt rotates, the uppermost sheet attracted to the sheet transfer belt is conveyed in the sheet conveying direction.

Another known sheet feeding device includes a shutter to open and close an opening formed in the reference face (the downstream side end) in order to lift the sheet stably by the air blowing device even when the number of sheets loaded on the sheet loading portion (the bottom plate) becomes smaller. To be more specific, the shutter opens the opening formed in the reference face (the downstream side end) as the number of sheets loaded on the sheet loading portion decreases.

SUMMARY

At least one aspect of this disclosure provides a sheet feeding device including a reference face, a sheet loader, an air blowing device, an air drawing device, and a conveying body. The reference face is configured to stand upwardly at a downstream side of a sheet conveying direction in which a sheet is conveyed. A sheet bundle including the sheet is loaded on the sheet loader. The sheet loader is configured to move in a vertical direction along the reference face according to a height of the sheet bundle loaded thereon. The sheet loader includes a body and a leading end disposed downstream from the body in the sheet conveying direction. The sheet loader is configured to move upwardly to a position where the leading end rotates downwardly to the body. The air blowing device is disposed downstream from the sheet loader in the sheet conveying direction and is configured to blow air toward the sheet bundle loaded on the sheet loader and lift an uppermost sheet placed on top of the sheet bundle. The air drawing device is disposed above the sheet loader and is configured to draw the uppermost sheet lifted by the air blowing device. The conveying body is configured to convey the uppermost sheet in the sheet conveying direction while the uppermost sheet is in contact with the air drawing device due to attraction by air.

Further, at least one aspect of this disclosure provides an image forming apparatus including the above-described sheet feeding device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
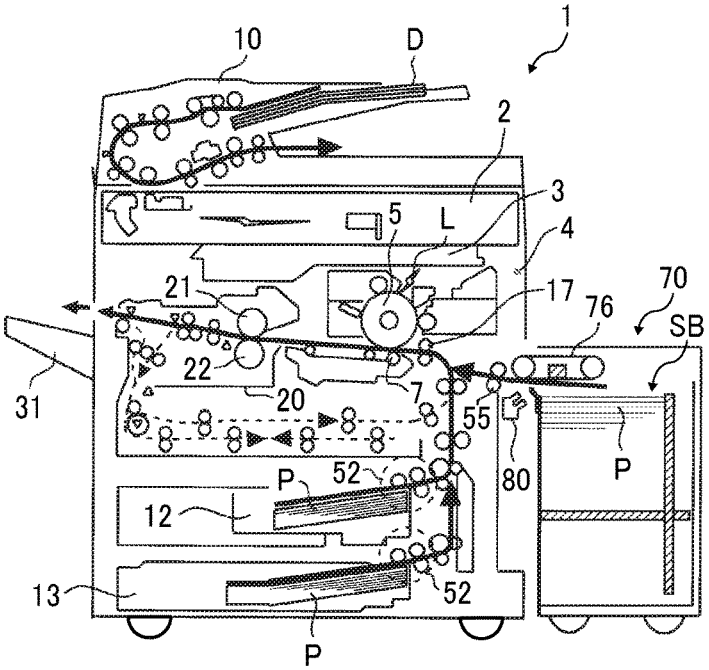
FIG. 1 is a diagram illustrating an overall configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus 1 according to an embodiment of this disclosure, with reference to drawings.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a sheet travels from an upstream side of a sheet conveying path to a downstream side thereof; the term "width direction" indicates a direction basically perpendicular to the sheet conveying direction.

Now, a description is given of a basic configuration and functions of the image forming apparatus 1 with reference to FIG. 1.

In FIG. 1, the image forming apparatus 1 includes a document reading device 2, an exposure device 3, an image forming device 4, a photoconductor drum 5, a transfer roller 7, a document conveying unit 10, a first sheet feed tray 12, a second sheet feed tray 13, a pair of registration rollers 17, a fixing device 20, a fixing roller 21, a pressure roller 22, a sheet output tray 31, and a sheet feeding device 70.

The document reading device 2 optically reads image data of an original document D.

The exposure device 3 emits an exposure light L based on the image data read by the document reading device 2 to irradiate the exposure light L on a surface of the photoconductor drum 5 that functions as an image bearer.

The image forming device 4 forms a toner image on the surface of the photoconductor drum 5.

The photoconductor drum 5 that functions as an image bearer and the transfer roller 7 that functions as a transfer body are included in the image forming device 4.

The transfer roller 7 transfers the toner image formed on the surface of the photoconductor drum 5 onto a sheet P.

The document conveying unit 10 functions as a document feeder that conveys the original document D set on a document tray or a document loader to the document reading device 2.

Each of the first sheet feed tray 12 and the second sheet feed tray 13 contains the sheet P such as a transfer sheet therein.

The pair of registration rollers 17 functions as a pair of timing rollers that conveys the sheet SP toward the transfer roller 7.

The fixing device 20 includes the fixing roller 21 and the pressure roller 22 to fuse an unfixed image formed on the sheet P to the sheet P by application of heat and pressure.

The sheet output tray 31 receives the sheet SP output from an apparatus body of the image forming apparatus 1.

The sheet feeding device 70 is a large capacity sheet feeding device that contains a large number of sheets P therein.

Now, a description is given of regular image forming operations performed by the image forming apparatus 1, with reference to FIG. 1.

The original document D is fed from a document loading table provided to the document conveying unit 10 and conveyed by multiple pairs of sheet conveying rollers disposed in the document conveying unit 10 in a direction indicated by arrow in FIG. 1 over the document reading device 2. At this time, the document reading device 2 optically reads image data of the original document D passing over the document reading device 2.

Consequently, the image data optically scanned by the document reading device 2 is converted to electrical signals. The converted electrical signals are transmitted to the exposure device 3 by which the image is optically written. Then, the exposure device 3 emits exposure light (laser light) L based on the image data of the electrical signals toward the surface of the photoconductor drum 5 of the image forming device 4.

By contrast, the photoconductor drum 5 of the image forming device 4 rotates in a clockwise direction in FIG. 1. After a series of predetermined image forming processes, e.g., a charging process, an exposing process, and a developing process, a toner image corresponding to the image data is formed on the surface of the photoconductor drum 5.

Thereafter, the toner image formed on the surface of the photoconductor drum 5 is transferred by the transfer roller 7, at a transfer nip region in the image forming device 4 where the transfer roller 7 and the photoconductor drum 5 contact to each other, onto the sheet P conveyed by the pair of registration rollers 17.

By contrast, the sheet P that is conveyed to the transfer roller 7 is handled as described below.

As illustrated in FIG. 1, one of the first sheet feed tray 12 and the second sheet feed tray 13 of the image forming apparatus 1 is selected automatically or manually. In the operations according to the present embodiment of this disclosure, the first sheet feed tray 12 that is an uppermost sheet tray is selected, for example. It is to be noted that the first sheet feed tray 12 and the second sheet feed tray 13 basically have an identical configuration to each other. Consequently, when the first sheet feed tray 12 of the image forming apparatus 1 is selected, an uppermost sheet P contained in the first sheet feed tray 12 is fed by a sheet feeding mechanism 52 toward a sheet conveyance passage. The sheet feeding mechanism 52 includes a sheet feed roller, a pickup roller, a backup roller, and so forth. Thereafter, the sheet P passes through the sheet conveyance passage in which multiple sheet conveying rollers are disposed, and reaches the pair of registration rollers 17.

It is to be noted that, when the sheet feeding device 70 that contains a large capacity of sheets (that is, a large capacity sheet feeding device) disposed at one side of the apparatus body of the image forming apparatus 1 is selected, an uppermost sheet P placed on top of a sheet bundle SB of multiple sheets loaded on a sheet loader 72 (see FIG. 2) of the sheet feeding device 70 is fed by a conveying belt 76*a* of a sheet conveying device 76 into the sheet conveyance passage where a pair of sheet feed rollers 55 is disposed, eventually reaching the pair of registration rollers 17.

After reaching the pair of registration rollers 17, the uppermost sheet P is then conveyed toward the transfer roller 7 in synchronization with movement of the toner image formed on the surface of the photoconductor drum 5 for positioning.

After completion of a transfer process, the sheet P passes the transfer roller 7 and reaches the fixing device 20 via the sheet conveyance passage. In the fixing device 20, the sheet P is conveyed between the fixing roller 21 and the pressure roller 22, so that the toner image is fixed to the sheet P by application of heat applied by the fixing roller 21 and pressure applied by the fixing roller 21 and the pressure roller 22, which is a fixing process. The sheet P with the toner fixed thereto after the fixing process passes a fixing nip region formed between the fixing roller 21 and the pressure roller 22. Then, the sheet P is output from the image forming apparatus 1. After having been output from the image forming apparatus 1, the sheet P is stacked as an output image, on the sheet output tray 31.

Accordingly, a series of image forming processes is completed.

Next, a detailed description is given of the sheet feeding device 70 (a large capacity sheet feeding device) according to an embodiment of this disclosure, with reference to FIGS. 2 through 6.

Figure 2:
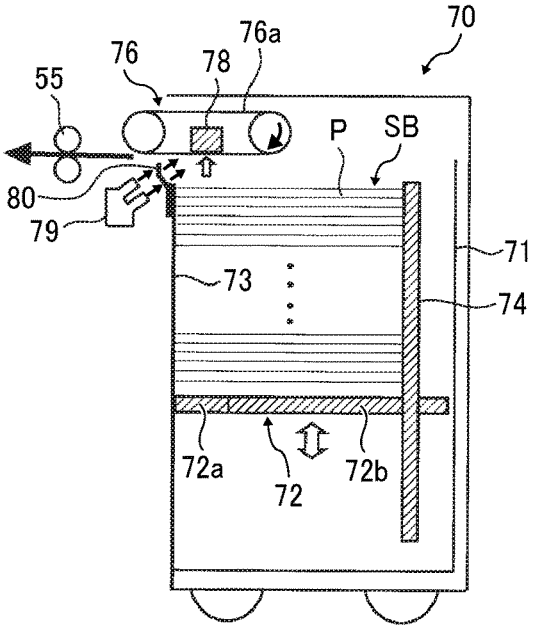
FIG. 2 is a diagram illustrating a sheet feeding device included in the image forming apparatus.
Figure 3A:
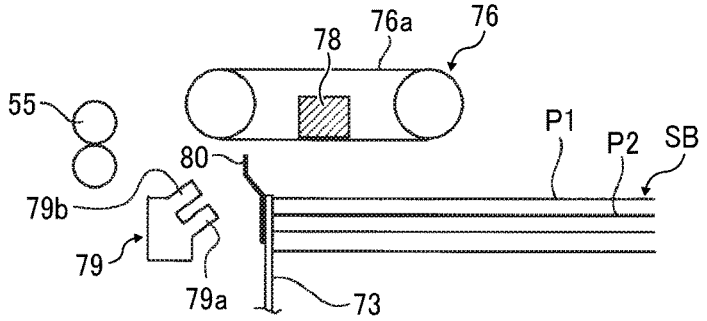
FIGS. 3A, 3B, 3C and 3D are diagrams illustrating a series of sheet feeding operations performed by the sheet feeding device.
Figure 3B:
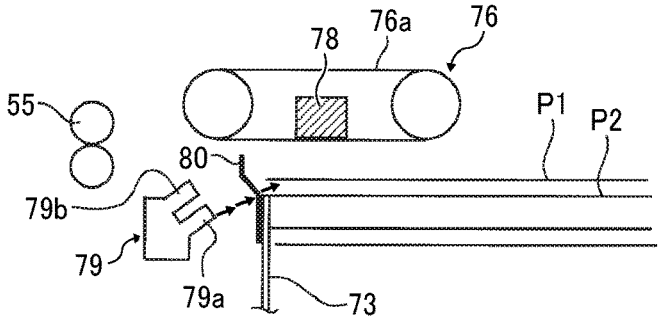
Figure 3C:
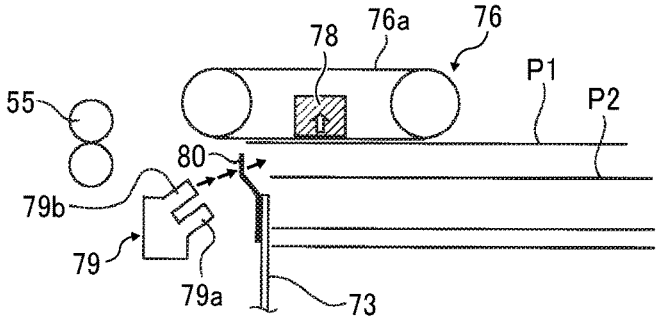
Figure 4A:
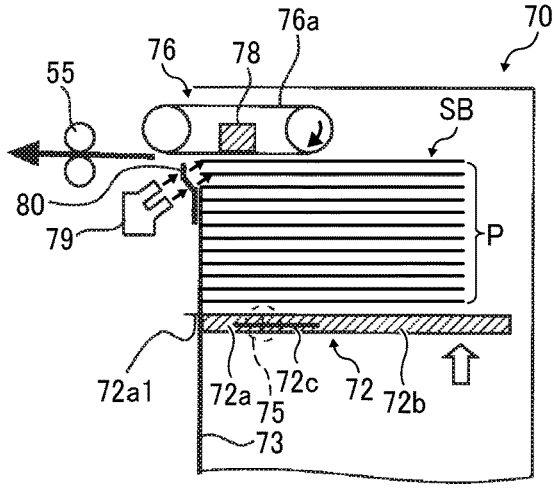
FIGS. 4A, 4B and 4C are diagrams illustrating a series of operations performed by a sheet loader of the sheet feeding device as the number of sheets loaded on the sheet loader decreases.
Figure 4B:
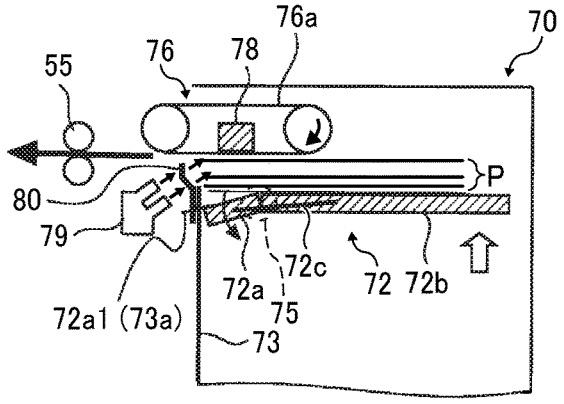
Figure 4C:
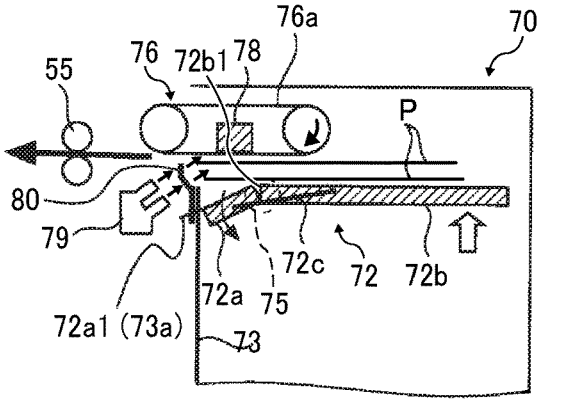
Figure 5A:
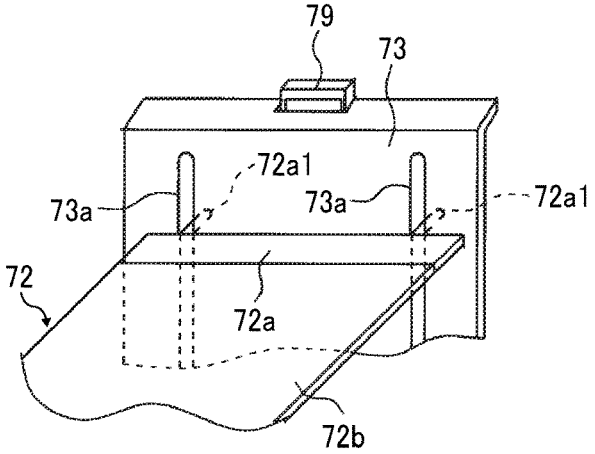
FIGS. 5A, 5B and 5C are perspective views illustrating a series of operations performed by the sheet loader as the number of sheets loaded on the sheet loader decreases.
Figure 5B:
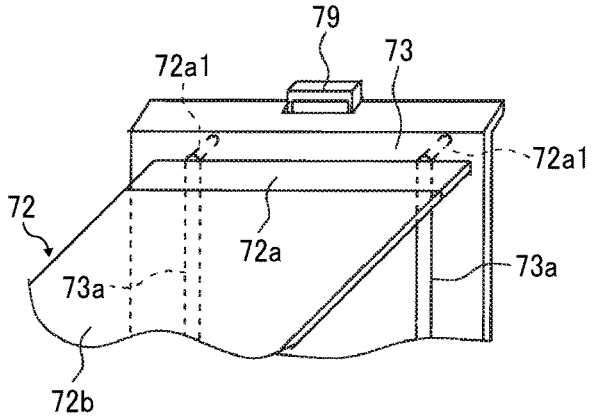
Figure 5C:
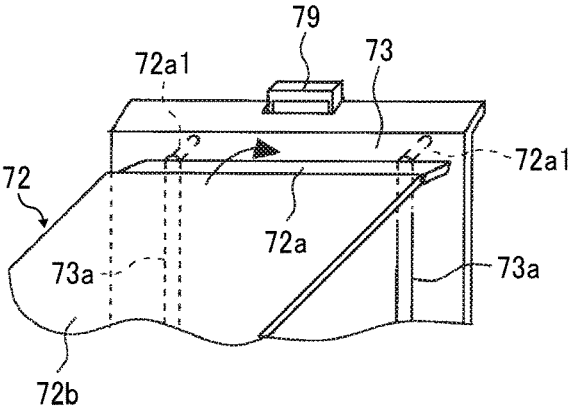
Figure 6:
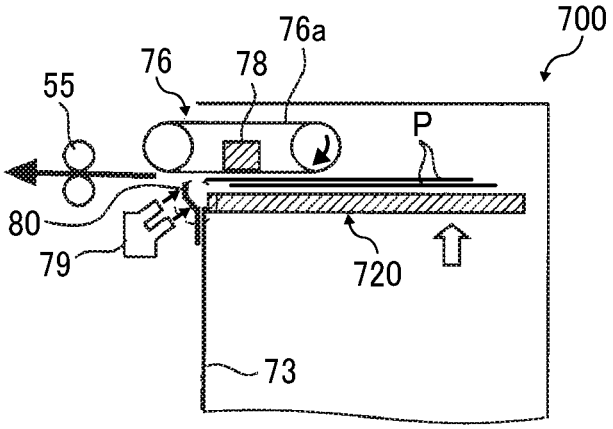
FIG. 6 is a diagram illustrating a comparative sheet feeding device when the number of sheets loaded on a sheet loader of the comparative sheet feeding device decreases.

FIG. 2 is a diagram illustrating the sheet feeding device 70 included in the image forming apparatus 1 according to an embodiment of this disclosure. FIGS. 3A, 3B, 3C and 3D are diagrams illustrating a series of sheet feeding operations performed by the sheet feeding device 70. FIGS. 4A, 4B and 4C are diagrams illustrating a series of operations performed by the sheet loader 72 of the sheet feeding device 70 as the number of sheets loaded on the sheet loader 72 decreases. FIGS. 5A, 5B and 5C are perspective views illustrating a series of operations performed by the sheet loader 72 as the number of sheets loaded on the sheet loader 72 decreases. FIG. 6 is a diagram illustrating a comparative sheet feeding device 700 when the number of sheets loaded on a sheet loader 720 of the comparative sheet feeding device 700 decreases.

Referring to FIGS. 2, 3A, 3B, 3C and 3D, the sheet feeding device 70 is a sheet feeding device to feed the sheet P in a predetermined sheet conveying direction, as indicated by arrow in FIG. 2, and includes a sheet container 71, a sheet conveying device 76, and an air blowing device 79.

The sheet container 71 includes the sheet loader 72 (a bottom plate), a reference face 73 (a reference fence), a regulating plate 80 that functions as a regulating portion, an end fence 74, and a side fence.

The sheet conveying device 76 includes the conveying belt 76*a* and an air drawing device 78 (a belt attraction device). The conveying belt 76*a* is wound around and stretched by two rollers.

Figure 3D:
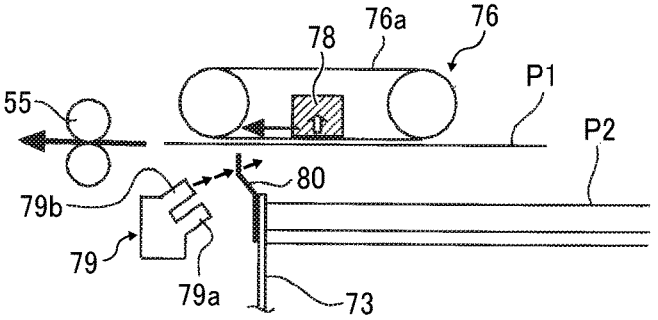

With this configuration, the sheet P contained in the sheet container 71 is fed by the sheet conveying device 76 in the sheet conveying direction indicated by arrow in FIGS. 2 and 3D.

To be more specific, the reference face 73 functions as an inner wall of the reference fence formed so as to upwardly stand in a vertical direction at a downstream side of the sheet loader 72 of the sheet container 71 in the sheet conveying direction.

The sheet loader 72 loads multiple sheets P in a state in which the multiple sheets P remain in contact with the reference face 73. Further, the sheet loader 72 is vertically movable such that an uppermost sheet P1 is located at a predetermined position in height even though the number of sheets P loaded on the sheet loader 72 varies. The predetermined position in height of the uppermost sheet P1 corresponds to the position depicted in FIG. 3 and is detected by a height detection sensor. That is, the sheet loader 72 loads multiple sheets P and elevates in the vertical direction indicated by white arrow in FIG. 2, operated by a loader elevation device according to the height of the loaded sheets P (the number of sheets loaded) on the sheet loader 72. The loader elevation device that causes the sheet loader 72 to elevate or vertically move may employ a known technique.

It is to be noted that a predetermined sensor setting position of the height detection sensor (that is, a position of the height detection sensor in a vertical direction) is determined based on the sheet rising and floating ability by the air blowing device 79 and the sheet attracting performance by the air drawing device 78 so that the conveying belt 76*a* can attract (draw) and convey the uppermost sheet P1 through the air. In the present embodiment of this disclosure, the height detection sensor is a reflection type photosensor that can be disposed facing a sheet P (i.e., the sheet P accommodated in the sheet container 71) via a light transmitting portion (e.g., a window) formed in the reference face 73 (i.e., the reference fence).

As illustrated in FIG. 2, the end fence 74 is movable manually (or automatically) at a position (i.e., an interval between the end fence 74 and the reference face 73) in the sheet conveying direction (i.e., in a left-and-right direction in FIG. 2) according to the size of the sheet P in the sheet conveying direction. It is to be noted that the end fence 74 are not depicted in FIGS. 3A through 3D and 4A through 4C.

The side fence (or side fences) is movable manually (or automatically) in a width direction of the sheet P (that is a direction perpendicular to the sheet conveying direction and vertical to the drawing sheet of FIG. 2) according to the size of the sheet P in the width direction.

After the sheet P (the sheet bundle SB) has been loaded on the sheet loader 72 by abutting the sheet P against the reference face 73, the side fence and the end fence 74 are moved to abut against the sheet P (the sheet bundle SB) loaded on the sheet loader 72. By so doing, the setting of the sheet P (the sheet bundle SB) in the sheet container 71 is completed.

In a comparative sheet feeding device, when the number of sheets loaded on a sheet loading portion (a bottom plate) of the comparative sheet feeding device becomes smaller, air blown from an air blowing device toward an uppermost sheet is blocked by the sheet loading portion that has been lifted along with decrease of the number of sheets. Once the above-described inconvenience occurs, the uppermost sheet cannot be separated from the rest of sheets on the sheet loading portion by the air blowing device, resulting in a sheet conveyance failure such as no sheet feeding or multifeeding.

Such inconvenience occurs even if the shutter to open and close the opening formed in the reference face is provided.

In order to address such inconvenience, the sheet container 71 of the sheet feeding device 70 according to an embodiment of this disclosure includes the regulating plate 80 above the reference face 73 (the reference fence).

The regulating plate 80 that functions as a regulating portion stands upwardly from the reference face 73. The regulating plate 80 regulates movement of a subsequent sheet P2 in the sheet conveying direction. The subsequent sheet P2 is placed below the uppermost sheet P1 that is lifted by (the air blown from a first air blowing nozzle 79*a* of) the air blowing device 79. That is, the regulating plate 80 (i.e., a regulating portion) prevents misfeed (multifeed) of the subsequent sheet P2, which is not supposed to be attracted and conveyed by the conveying belt 76*a*, is fed and conveyed together with the uppermost sheet P1, which is supposed to be attracted and conveyed by the conveying belt 76*a*. Specifically, when the subsequent sheet P2 is about to be fed together with the uppermost sheet P1, the subsequent sheet P2 is interfered by the regulating plate 80, so that the movement (conveyance) of the subsequent sheet P2 in the sheet conveying direction is regulated.

As illustrated in FIGS. 2 and 3A through 3D, the air blowing device 79 is disposed downstream from the sheet loader 72 (the sheet container 71) in the sheet conveying direction (that is, on the left side of FIGS. 2 and 3A through 3D). The air blowing device 79 blows air toward the uppermost sheet P1 placed on top of the sheet bundle SB loaded on the sheet loader 72, so as to lift and float the uppermost sheet P1, as illustrated in FIG. 3B.

To be more specific, the air blowing device 79 includes an air blowing fan, an air blowing duct, the first air blowing nozzle 79*a*, a second air blowing nozzle 79*b*, and shutters to respectively open and close the first air blowing nozzle 79*a* and the second air blowing nozzle 79*b*. With this configuration, air drawn by the air blowing fan is blown from the first air blowing nozzle 79*a* via the air blowing duct. The air is then blown to the uppermost sheet P1 (and the subsequent sheet P2 that lies below the uppermost sheet P1 in the sheet bundle SB). Consequently, the uppermost sheet P1 is separated from the sheet bundle SB due to positive air pressure, resulting in a rise and floating of the uppermost sheet P1 in the air. Since the air drawing device 78 draws air above the sheet bundle SB, the uppermost sheet P1 is encouraged to move toward the conveying belt 76*a*.

It is to be noted that a time at which the air blowing device 79 blows air through the first air blowing nozzle 79*a* toward the uppermost sheet P1 is preferably at the same time as or earlier than a time at which the air drawing device 78 starts an air drawing operation.

As described above, the air blowing device 79 according to the present embodiment of this disclosure includes the second air blowing nozzle 79*b* disposed downstream from the sheet loader 72 (the sheet container 71) in the sheet conveying direction. The second air blowing nozzle 79*b* blows air between the uppermost sheet P1 lifted by the first air blowing nozzle 79*a* of the air blowing device 79 and the subsequent sheet P2, so as to separate the subsequent sheet P2 from the uppermost sheet P1.

To be more specific, the air blowing device 79 includes a first shutter to open and close the first air blowing nozzle 79*a* and a second shutter to open and close the second air blowing nozzle 79*b*. The opening and closing motion of the first shutter and the opening and closing motion of the second shutter are controlled as follows. The air blowing device 79 blows air toward the uppermost sheet P1 to lift the uppermost sheet P1 when the first air blowing nozzle 79*a* is opened and the second air blowing nozzle 79*b* is closed, as illustrated in FIG. 3B. By contrast, the air blowing device 79 blows air between the uppermost sheet P1 and the subsequent sheet P2 to separate the subsequent sheet P2 form the uppermost sheet P1 when the first air blowing nozzle 79*a* is closed and the second air blowing nozzle 79*b* is opened, as illustrated in FIG. 3C.

As illustrated in FIGS. 2 and 3A through 3D, the air drawing device 78 is disposed above the sheet loader 72 (the sheet container 71). The air drawing device 78 draws (attracts) the uppermost sheet P1 that is lifted in the air by the air blowing device 79 (specifically, by air blown from the first air blowing nozzle 79*a*). In other words, the air drawing device 78 generates negative air pressure above the sheet bundle SB loaded on the sheet loader 72 so as to draw (attract) the uppermost sheet P1.

To be more specific, the air drawing device 78 includes an air drawing fan, an air drawing duct, an air drawing chamber, and so forth. The air drawing chamber is disposed inside a loop of the conveying belt 76*a* and has an opening formed in a bottom portion thereof. The air drawing chamber communicates through the opening with a spaced portion below via multiple small diameter openings formed in the conveying belt 76*a*. At least one of the multiple small diameter openings of the conveying belt 76*a*, formed at one end side in the width direction of the air drawing chamber is connected to the air drawing fan via the air drawing duct. Then, as the air drawing fan is driven and rotated, air is drawn from the bottom portion of the conveying belt 76*a* as indicated by white arrow illustrated in FIG. 2.

Referring to FIGS. 2 and 3A through 3D, the conveying belt 76*a* conveys the uppermost sheet P1 in the sheet conveying direction in a state in which the uppermost sheet P1 remains in contact with the air drawing device 78 due to attraction by air.

To be more specific, the conveying belt 76*a* is disposed to extend over an outlet port of the sheet feeding device 70 at the extreme downstream side in the sheet conveying direction above the sheet container 71. The conveying belt 76*a* is stretched and supported by two rollers. As one of the rollers is driven by a drive motor, the conveying belt 76*a* is rotated (moved) in a clockwise direction as illustrated in FIG. 2. As described above, the conveying belt 76*a* has the multiple small diameter openings over the whole surface thereof.

Next, a description is given of a series of normal operations performed by the sheet feeding device 70 according to the present embodiment of this disclosure, with reference to FIGS. 3A through 3D.

As illustrated in FIG. 3A, a full set of sheets including the uppermost sheet P1 and the subsequent sheet P2 is loaded on the sheet loader 72 (the sheet container 71).

As a print key provided on the apparatus body of the image forming apparatus 1, the first air blowing nozzle 79*a* of the air blowing device 79 blows air toward the uppermost sheet P1, so that the uppermost sheet P1 is lifted and floated toward the sheet conveying device 76, as illustrated in FIG. 3B. At the substantially same time, the air drawing device 78 starts the air drawing operation, and therefore the uppermost sheet P1 is attracted to the conveying belt 76*a*, as illustrated in FIG. 3C. It is to be noted that, when the air blowing device 79 blows air to the uppermost sheet P1 in a state illustrated in FIG. 3B, the subsequent sheet P2 is lifted together with the uppermost sheet P1.

Thereafter, as illustrated in FIG. 3C, air is blown from the second air blowing nozzle 79*b* of the air blowing device 79 between the uppermost sheet P1 and the subsequent sheet P2. The blown air separates the subsequent sheet P2 from the uppermost sheet P1, and the subsequent sheet P2 separated from the uppermost sheet P1 falls onto the sheet loader 72.

Then, as illustrated in FIG. 3D, the conveying belt 76*a* starts rotating (moving) in a direction indicated by arrow depicted in the loop of the conveying belt 76*a* in FIG. 3D. With this rotation of the conveying belt 76*a*, the uppermost sheet P1 attracted to the conveying belt 76*a* is conveyed toward the pair of sheet feed rollers 55.

Then, the uppermost sheet P1 is conveyed in the sheet conveying direction as indicated by arrow illustrated in FIG. 3D. After a trailing end of the uppermost sheet P1 has passed below the air drawing device 78, the subsequent sheet P turns to another uppermost sheet P1, and the sheet feeding operation illustrated in FIGS. 3B through 3D are repeated.

Now, referring to FIGS. 4A through 4C and 5A through 5C, when the number of sheets P loaded on the sheet loader 72 decreased and reached a threshold amount (a predetermined number of sheets) and the sheet loader 72 is lifted to a predetermined position in the sheet feeding device 70 according to the present embodiment, a leading end 72*a* of the sheet loader 72 rotates relative to a loader body 72*b* of the sheet loader 72 about a boundary 75 (encircled by a broken line in FIGS. 4A through 4C) of the leading end 72*a* and the loader body 72*b* of the sheet loader 72, toward a downward direction.

Specifically, the sheet loader 72 includes the leading end 72*a* and the loader body 72*b*. The leading end 72*a* of the sheet loader 72 rotates about the boundary 75 of the leading end 72*a* and the loader body 72*b*, as a center axis of rotation of the leading end 72*a*, in the counterclockwise direction in FIGS. 4A through 4C.

While the sheet loader 72 is moving upwardly, that is, until the sheet loader 72 reaches the predetermined position, the leading end 72*a* and the loader body 72*b* of the sheet loader 72 remain substantially horizontal or flat relative to each other. That is, as illustrated in FIGS. 4A and 5A, when a sufficient amount (height) of bundle of sheets P is loaded on the sheet loader 72, the leading end 72*a* of the sheet loader 72 does not rotate, and therefore a horizontal (flat) loader face is maintained by the leading end 72*a* and the loader body 72*b* of the sheet loader 72.

By contrast, as illustrated in FIGS. 4B and 5C, when the remaining number (amount) of sheets P loaded on the sheet loader 72 decreases and approaches the predetermined threshold amount, the leading end 72*a* rotates about the boundary 75 with the loader body 72*b* in a direction indicated by arrow in FIGS. 4B and 5C. Accordingly, in this state, the sheet loader 72 has the loader face being flat from the trailing end to the boundary 75 and inclined downwardly from the boundary 75 to the leading end 72*a*.

According to this configuration, even when the number of sheets P loaded on the sheet loader 72 decreases, it is not likely that air blown from the air blowing device 79 toward the uppermost sheet P1 (or between the uppermost sheet P1 and the subsequent sheet P2) is blocked by the sheet loader 72 that has been lifted along with the reduction of the number of sheets P on the sheet loader 72.

As illustrated in FIG. 6, the comparative sheet feeding device 700 includes a sheet loader 720. When the number of sheets P loaded on the sheet loader 720 decreases, air blown from the air blowing device 79 toward the uppermost sheet P1 (or between the uppermost sheet P1 and the subsequent sheet P2) is blocked by the sheet loader 720 that has been lifted along with the reduction of the number of sheets P on the sheet loader 720. Therefore, the air blowing device 79 cannot separate the uppermost sheet P1 from the subsequent sheet P2 smoothly. As a result, sheet conveyance failure such as no sheet feeding or multifeeding has occurred.

By contrast, in the sheet feeding device 70 according to the present embodiment of this disclosure, as the number (amount) of sheets P loaded on the sheet loader 72 decreases, the leading end 72*a* of the sheet loader 72 is rotated in the downward direction so as not to block air blown from the air blowing device 79. This can prevent the sheet conveyance failure such as no sheet feeding or multifeeding occurred when the air blowing device 79 does not separate the uppermost sheet P1 successfully.

In the present embodiment of this disclosure, after the sheet loader 72 has been elevated to a predetermined position, as illustrated in FIG. 5B, as the distance of movement of the sheet loader 72 in an upward direction extends, the angle of rotation of the leading end 72*a* of the sheet loader 72 in the downward direction relative to the loader body 72*b* increases.

That is, when the number (amount) of sheets P loaded on the sheet loader 72 decreases and the sheet loader 72 is elevated above the predetermined position, the leading end 72*a* of the sheet loader 72 starts rotating in the counterclockwise direction in FIGS. 4A through 4C. Then, as the number (amount) of sheets P further decreases and the sheet loader 72 is further elevated, the leading end 72*a* of the sheet loader 72 is further rotated in the counterclockwise direction in FIGS. 4A through 4C. When the sheet loader 72 is elevated from the position illustrated in FIG. 4B to the position illustrated in FIG. 4C, the leading end 72*a* of the sheet loader 72 rotates in the counterclockwise direction in FIGS. 4A through 4C along with the elevation of the sheet loader 72.

Accordingly, even when the number of sheets P loaded on the sheet loader 72 gradually decreases and the air blown from the air blowing device 79 is likely to be blocked by the sheet loader 72, the leading end 72*a* of the sheet loader 72 rotates downwardly at an optimum angle according to the height of elevation of the sheet loader 72. Therefore, this configuration can further prevent the sheet conveyance failure such as no sheet feeding or multifeeding occurred when the air blowing device 79 does not separate the uppermost sheet P1 successfully.

Now, a description is given of the configuration of the sheet feeding device 70 in which the leading end 72*a* of the sheet loader 72 performs the above-described operations.

As illustrated in FIGS. 5A through 5C, the reference face 73 has openings 73*a* (each in a shape of a slot), each of which functions as a recess that extends in the vertical direction (that is, the upward and downward directions). Specifically, the reference face 73 has two openings 73*a* at respective positions spaced from each other in the width direction, which is a direction perpendicular to the sheet conveying direction and orthogonal to the drawing sheet of FIGS. 4A through 4C.

By contrast, the leading end 72*a* of the sheet loader 72 is supported by the loader body 72*b*, rotatably about the boundary 75 of the leading end 72*a* and the loader body 72*b*, at a position below the boundary 75. Further, shaft-shaped projections 72*a*1 are mounted on an end face of the leading end 72*a* of the sheet loader 72. Each of the projections 72*a*1 has a shaft shape to be inserted into each of the openings 73*a* of the reference face 73. Specifically, the sheet loader 72 has two projections 72*a*1 at the leading end 72*a*, at respective positions spaced from each other in the width direction of the sheet loader 72.

When the sheet loader 72 is elevated from the position illustrated in FIG. 5A to the position illustrated in FIG. 5B, the projections 72*a*1 of the leading end 72*a* of the sheet loader 72 contact the upper end of the openings 73*a* of the reference face 73. Then, along with elevation of the loader body 72*b* of the sheet loader 72, the leading end 72*a* of the sheet loader 72 rotates relative to the loader body 72*b* of the sheet loader 72 about the boundary 75 of the leading end 72*a* and the loader body 72*b*, as illustrated in FIG. 5C. That is, after the leading end 72*a* of the sheet loader 72 has reached a predetermined position, as illustrated in FIG. 5B, elevation of the projections 72*a*1 of the leading end 72*a* of the sheet loader 72 is regulated by the openings 73*a* of the reference face 73 so that the leading end 72*a* of the sheet loader 72 does not move further upwardly. Since the boundary 75 of the leading end 72*a* and the loader body 72*b* of the sheet loader 72 moves up, the leading end 72*a* of the sheet loader 72 rotates relative to the loader body 72*b* of the sheet loader 72 about the boundary 75 of the leading end 72*a* and the loader body 72*b*.

It is to be noted that the configuration of the present embodiment includes the reference face 73 having the openings 73*a* extending in the vertical direction (that is, the upward and downward directions), so that the projections 72*a*1 of the leading end 72*a* of the sheet loader 72 are inserted into the openings 73*a* of the reference face 73. However, the configuration is not limited thereto. For example, the reference face 73 may include grooves, each of which functions as a recess extending in the vertical direction into which the projections 72*a*1 of the leading end 72*a* of the sheet loader 72 are inserted.

As illustrated in FIGS. 4A through 4C, the sheet loader 72 further includes tension springs 72*c*, each of which functions as a biasing body. The tension springs 72*c* bias the leading end 72*a* so as to rotate the leading end 72*a* toward the upward direction relative to the loader body 72*b* of the sheet loader 72 about the boundary 75 encircled by the broken line. To be more specific, each of the tension springs 72*c* (the biasing body) has one end hooked to a shaft that stands upwardly on both side faces of the leading end 72*a* of the sheet loader 72 and the other end, which is an opposite end of the one end, hooked to a shaft that stands upwardly on both side faces of the loader body 72*b* of the sheet loader 72. According to this configuration, the tension springs 72*c* apply a biasing force to the leading end 72*a* of the sheet loader 72 to rotate about the boundary 75 in the clockwise direction in FIGS. 4A through 4C.

Further, the sheet loader 72 includes a regulator 72*b*1 to regulate a range of rotation of the leading end 72*a* to rotate relative to the loader body 72*b* in the upward direction, i.e., a range of rotation of the leading end 72*a* in the clockwise direction of FIGS. 4A through 4C. The regulator 72*b*1 corresponds to an end face of the loader body 72*b* of the sheet loader 72 in the boundary 75 encircled by the broken line in FIGS. 4A through 4C. By contacting the end face of the leading end 72*a* and the loader body 72*b* with each other in the boundary 75, the rotation of the leading end 72*a* of the sheet loader 72 in the clockwise direction against the biasing force applied by the tension springs 72*c* is limited and, at the same time, a flat loader face is formed by the leading end 72*a* and the loader body 72*b* of the sheet loader 72.

In the present embodiment, the sheet loader 72 is formed such that a length in the sheet conveying direction of the leading end 72*a* of the sheet loader 72 is less (shorter) than a length in the sheet conveying direction of a sheet P loaded on the sheet loader 72 (that is, a sheet P of a smallest size loadable on the sheet loader 72). Further, the sheet loader 72 is also formed such that the center of gravity of the sheet P loaded on the sheet loader 72 (that is, a sheet P of a smallest size loadable on the sheet loader 72) is located at an upper portion of the loader body 72*b*.

According to this configuration, even when the number of sheets P loaded on the sheet loader 72 is decreased and the leading end 72*a* of the sheet loader 72 is rotated about the boundary 75, the sheet P loaded on the sheet loader 72 is not loaded on a sloped face of the leading end 72*a* of the sheet loader 72 but is loaded on the loader body 72*b* in well balance. Accordingly, a good sheet feeding operation can be performed with the air blowing device 79, the air drawing device 78, and the sheet conveying device 76 as described with reference to FIGS. 4A through 4C, even to the sheet bundle SB having a small amount left.

A description is given of movements of the sheet loader 72 (specifically, the leading end 72*a*) as the number of sheets P loaded on the sheet loader 72 decreases in the sheet feeding device 70 having the above-described configuration, with reference to FIGS. 4A through 4C and 5A through 5C.

First, when the sheets P (the sheet bundle SB) are fully loaded on the sheet loader 72, as illustrated in FIG. 4A, the leading end 72*a* of the sheet loader 72 is biased by the tension springs 72*c* to be rotated in the clockwise direction, so that the leading end 72*a* contacts the loader body 72*b* of the sheet loader 72. Accordingly, a horizontal (flat) loader face is formed by the leading end 72*a* and the loader body 72*b*, as illustrated in FIGS. 4A and 5A. Then, each time the uppermost sheet P1 placed on top of the sheet bundle SB is fed from the sheet loader 72, the sheet loader 72 slides upwardly with the projections 72*a*1 of the leading end 72*a* being inserted into the openings 73*a* of the reference face 73 while maintaining the loader face in a horizontal state.

As the image forming operation is repeatedly performed, the number of sheets P remaining on the sheet loader 72 is reduced. Upon arrival of the sheet loader 72 to the predetermined position illustrated in FIG. 5B, the projections 72*a*1 of the leading end 72*a* contacts the upper end of the openings 73*a* of the reference face 73. Thereafter, as illustrated in FIGS. 4B and 5C, as the loader body 72*b* of the sheet loader 72 is elevated along with a reduction of the number of sheets P loaded on the sheet loader 72, the leading end 72*a* of the sheet loader 72 starts rotating about the boundary 75 of the leading end 72*a* and the loader body 72*b*.

Then, as illustrated in FIG. 4C, as the loader body 72*b* of the sheet loader 72 is further elevated along with a further reduction of the number of sheets P on the sheet loader 72, the leading end 72*a* of the sheet loader 72 continues rotating about the boundary 75 of the leading end 72*a* and the loader body 72*b*.

As described above, the sheet feeding device 70 according to the present embodiment includes the sheet loader 72, the reference face 73, the air blowing device 79, the air drawing device 78, and the conveying belt 76*a*. When the sheet loader 72 on which the sheet P or the sheet bundle SB including the sheet P is loaded is elevated to the predetermined position, the leading end 72*a* of the sheet loader 72 provided at the downstream side in the sheet conveying direction rotates relative to the loader body 72*b* of the sheet loader 72 downwardly about the boundary 75 of the leading end 72*a* and the loader body 72*b* of the sheet loader 72.

According to this configuration, even when the number of remaining sheets P on the sheet loader 72 is decreased, the sheet conveyance failure such as no sheet feeding or multifeeding can be restrained or prevented.

It is to be noted that the present embodiment of this disclosure is applied to the sheet feeding device 70 provided to the image forming apparatus 1 that performs monochrome image formation. However, this disclosure is not limited thereto. For example, this disclosure can also be applied to a sheet feeding device provided to an image forming apparatus that performs color image formation.

Further, it is to be noted that the present embodiment of this disclosure is applied to the sheet feeding device 70 provided to the image forming apparatus 1 that employs electrophotography. However, this disclosure is not limited thereto. For example, this disclosure can also be applied to a sheet feeding device provided to an image forming apparatus that employs an inkjet method or a stencil printing machine.

Further, it is to be noted that the present embodiment of this disclosure is applied to the sheet feeding device 70 that can hold the large capacity of sheets. However, this disclosure is not limited thereto. For example, this disclosure can also be applied to the first sheet feed tray 12 and the second sheet feed tray 13 both functioning as a sheet feeding device, as long as the first sheet feed tray 12 and the second sheet feed tray 13 employ an air drawing method. Further, this disclosure can also be applied to the document conveying unit 10 (the ADF) that functions as a sheet feeding device as long as the document conveying unit 10 employs an air drawing method.

Further, when the above-described sheet feeding devices such as the sheet feeding device 70, the first sheet feed tray 12, the second sheet feed tray 13, and the document conveying unit 10 can achieve the same effect as the effect provided by the configuration(s) in the present embodiment.

It is to be noted that, as described above, a "sheet" is not limited to indicate a paper material but also includes other materials such as a plastic material (e.g., an OHP film sheet) and a fabric sheet. In addition, the "sheet" is not limited to a transfer sheet or recording medium to be printed but is applicable to an original document to be fed in a sheet feeding device such as an automatic document feeder.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeding device comprising:

a reference face standing upwardly at a downstream side of a sheet conveying direction in which a sheet is conveyed;

a sheet loader on which a sheet bundle including the sheet is loaded and configured to move in a vertical direction along the reference face according to a height of the sheet bundle loaded thereon, the sheet loader arranged horizontally with respect to the reference face, the sheet loader including:

a horizontal loader body and a rotatable body disposed downstream from and rotatable attached to the horizontal loader body in the sheet conveying direction, the rotatable body being rotatable relative to the horizontal loader body about a boundary of separation of the sheet loader between the rotatable body and the horizontal loader body, the sheet loader configured to move upwardly to a position where the rotatable body rotates downwardly;

an air blowing device disposed downstream from the sheet loader in the sheet conveying direction, the air blowing device configured to blow air toward the sheet bundle loaded on the sheet loader and lift an uppermost sheet of the sheet bundle;

an air drawing device disposed above the sheet loader, the air drawing device configured to draw the uppermost sheet lifted by the air blowing device; and a conveying body configured to convey the uppermost sheet in the sheet conveying direction while the uppermost sheet is in contact with the air drawing device due to attraction by air, wherein the reference face has a recess formed extending in the vertical direction, wherein the rotatable body of the sheet loader has a projection inserted into the recess of the reference face, and wherein, when the sheet loader is elevated to the position, the projection of the rotatable body contacts an upper end of the recess of the reference face, and the rotatable body rotates relative to the horizontal loader body along with elevation of the horizontal loader body.

2. The sheet feeding device according to claim 1, wherein the conveying body is a conveying belt.

3. The sheet feeding device according to claim 1, wherein, after elevation of the sheet loader to the position, as a distance of movement of the sheet loader in an upward direction extends, an angle of rotation of the rotatable body in a downward direction increases relative to the horizontal loader body.

4. The sheet feeding device according to claim 3, wherein, until the sheet loader reaches the position, the rotatable body and the horizontal loader body form a horizontal loader face.

5. The sheet feeding device according to claim 1, wherein the recess includes an opening.

6. The sheet feeding device according to claim 1, wherein, until the sheet loader reaches the position, the rotatable body and the horizontal loader body form a horizontal loader face.

7. The sheet feeding device according to claim 1, wherein the sheet loader further includes:

a biasing body configured to bias the rotatable body operable to rotate the rotatable body toward an upward direction relative to the horizontal loader body; and a regulator configured to regulate a range of rotation of the rotatable body to rotate toward the upward direction relative to the horizontal loader body.

8. The sheet feeding device according to claim 1, wherein a length of the rotatable body in the sheet conveying direction is less than a length of the sheet loaded on the sheet loader, in the sheet conveying direction.

9. The sheet feeding device according to claim 8, wherein a center of gravity of the sheet loaded on the sheet loader is located at an upper portion of the horizontal loader body.

10. The sheet feeding device according to claim 1, wherein a center of gravity of the sheet loaded on the sheet loader is located at an upper portion of the horizontal loader body.

11. The sheet feeding device according to claim 1, wherein, when the number of sheets loaded on the sheet loader decreases to a threshold amount, the sheet loader is lifted to the position.

12. An image forming apparatus comprising the sheet feeding device according to claim 1.

13. A sheet feeding device comprising:

a reference face standing upwardly at a downstream side of a sheet conveying direction in which a sheet is conveyed;

a sheet loader on which a sheet bundle including the sheet is loaded and configured to move in a vertical direction along the reference face according to a height of the sheet bundle loaded thereon, the sheet loader including:

a loader body; and a rotatable body disposed downstream from the loader body in the sheet conveying direction, the rotatable body being attached to and rotatable relative to the loader body about a boundary of separation between the rotatable body and the loader body, the sheet loader configured to move upwardly to a position where the rotatable body rotates downwardly to the loader body;

an air blowing device disposed downstream from the sheet loader in the sheet conveying direction, the air blowing device configured to blow air toward the sheet bundle loaded on the sheet loader and lift an uppermost sheet of the sheet bundle;

an air drawing device disposed above the sheet loader, the air drawing device configured to draw the uppermost sheet lifted by the air blowing device; and a conveying body configured to convey the uppermost sheet in the sheet conveying direction while the uppermost sheet is in contact with the air drawing device due to attraction by air, wherein, after elevation of the sheet loader to the position, as a distance of movement of the sheet loader in an upward direction extends, an angle of rotation of the rotatable body in a downward direction relative to the loader body increases, wherein, until the sheet loader reaches the position, the rotatable body and the loader body form a horizontal loader face, after elevation of the sheet loader to the position, as a distance of movement of the sheet loader in an upward direction extends, an angle of rotation of the rotatable body in a downward direction relative to the loader body increases, wherein the reference face has a recess formed extending in the vertical direction, wherein the rotatable body of the sheet loader has a projection configured to be inserted into the recess of the reference face, and wherein, when the sheet loader is elevated to the position, the projection of the rotatable body contacts an upper end of the recess of the reference face, and the rotatable body rotates relative to the loader body along with elevation of the loader body.

14. The sheet feeding device according to claim 13, wherein the recess includes an opening.

* * * * *